US006712934B2

(12) United States Patent
Ahlgren et al.

(10) Patent No.: US 6,712,934 B2
(45) Date of Patent: Mar. 30, 2004

(54) METHOD FOR PRODUCTION OF PAPER

(75) Inventors: Jonni Ahlgren, Vaasa (FI); Kimmo Strengell, Vaasa (FI)

(73) Assignee: Kemira Chemicals Oy, Helsinki (FI)

( * ) Notice: Subject to any disclaimer, the term of this patent is extended or adjusted under 35 U.S.C. 154(b) by 0 days.

(21) Appl. No.: 10/148,691

(22) PCT Filed: Dec. 4, 2000

(86) PCT No.: PCT/FI00/01069

§ 371 (c)(1),
(2), (4) Date: May 31, 2002

(87) PCT Pub. No.: WO01/40577

PCT Pub. Date: Jun. 7, 2001

(65) Prior Publication Data

US 2003/0079848 A1 May 1, 2003

(30) Foreign Application Priority Data

Dec. 2, 1999 (FI) ..... 19992598

(51) Int. Cl.[7] ..... D21H 17/63; D21H 17/68

(52) U.S. Cl. ..... 162/181.6; 162/181.8; 162/168.3; 162/183

(58) Field of Search ..... 162/128, 168.1, 162/168.2, 168.3, 181.1, 181.6, 181.7, 181.8, 183–186, 164.1–164.7; 106/468–470, 482–486, DIG. 4; 423/331–335, 326; 210/716, 717, 723, 731, 732, 667

(56) References Cited

U.S. PATENT DOCUMENTS

| | | | | | |
|---|---|---|---|---|---|
| 4,753,710 | A | | 6/1988 | Langley et al. | 162/164.3 |
| 5,178,730 | A | * | 1/1993 | Bixler et al. | 162/168.3 |
| 5,194,120 | A | * | 3/1993 | Peats et al. | 162/168.3 |
| 5,798,023 | A | * | 8/1998 | Pruszynski et al. | 162/181.1 |
| 5,810,971 | A | | 9/1998 | Chung | 162/168.1 |
| 5,876,563 | A | | 3/1999 | Greenwood | 162/175 |

FOREIGN PATENT DOCUMENTS

| | | | | |
|---|---|---|---|---|
| EP | 0 310 959 | * | 4/1989 | D21D/3/00 |
| EP | 0310959 A1 | | 4/1989 | |
| FI | 67736 | | 10/1982 | |
| FI | 67735 | | 3/1983 | |
| FI | 89731 | | 4/1989 | |
| FI | 950585 A | | 10/1995 | |
| WO | 9405595 A1 | | 3/1994 | |
| WO | WO 94/05595 | * | 3/1994 | C01B/33/14 |
| WO | WO 99/14432 | | 3/1999 | |
| WO | 0066833 A1 | | 11/2000 | |

OTHER PUBLICATIONS

WPI/Derwent's Abstract, No. 1990–095566, DW199013, Abstract of JP 2047394.

* cited by examiner

*Primary Examiner*—Peter Chin
*Assistant Examiner*—Eric Hug
(74) *Attorney, Agent, or Firm*—Birch, Stewart, Kolasch & Birch, LLP

(57) ABSTRACT

The invention relates to a method for the production of paper or board, wherein retention aids are added to the stream of stock. Improved retention and more effective dewatering are achieved by adding to the stream of stock a cationic polymer solution and a suspension-form microparticle mixture composed of a swellable clay of the smectite group and a colloidal synthetic metal silicate in which the prevalent cation is magnesium.

11 Claims, No Drawings

METHOD FOR PRODUCTION OF PAPER

This application is the national phase under 35 U.S.C. §371 of PCT International Application No. PCT/FI00/01069 which has an International filing date of Dec. 4, 2000, which designated the United States of America.

The present invention relates to a method for the production of paper and board, wherein there is used as a retention aid in the retention system a solution of a cationic polymer together with a microparticle mixture which contains a swellable clay of the smectite group.

At present, the use of microparticles in the retention system of paper production, in particular in the production of fine paper, is very common, the aim being to improve further the efficiency of the production process. The advantages of the adoption into use of microparticles include improved retention, more efficient dewatering, and better formation. The most effective of the microparticles in use are colloidal silica-based microparticles of various types, solid or sol, and bentonite-like swellable natural materials belonging to the smectite group of clays. Instead of, or in addition to, a microparticulate compound it is possible to use as a retention aid in the retention system polymers, which may be anionic, cationic or non-ionic, and which are characterized by a high molecular weight. The problem involved with these compounds is typically excessive flocculation, which deteriorates the optical properties of paper.

The silicates may be natural crystalline minerals or synthetic materials. Synthetic silicates have the advantage of better controllable properties, in which case the efficiency of the microparticulate material used can be maximized. The colloidal synthetic silicates used as retention aids in retention systems include, for example, colloidal silica and polysilicate, aluminum silicates, and aluminum silicates modified with alkali metals and with alkaline-earth metals. The particle size of these materials is typically a few nanometers or a few tens of nanometers, and they are more expensive than, for example, bentonite.

The minerals of the smectite group of natural clays include montmorillonite, beidellite, nontronite, saponite and sauconite, which are composed mainly of aluminum silicates and some of which contain, in addition to sodium, also other cations, such as magnesium, iron, calcium or zinc. Smectites also include hectorite and vermiculite, which are, instead, composed mainly of magnesium silicate and contain to a lesser extent also other cations. Natural clays are typically somewhat darker than synthetic materials, owing to impurities present in them.

Bentonite is a species of rock mainly composed of montmorillonite (Kirk-Othmer Encyclopedia of Chemical Technology, Part 6, $4^{th}$ edition, p. 394). However, the name bentonite is commonly also used of commercial products which contain mainly montmorillonite. Bentonite-type materials have been used in paper production especially as materials adsorbing impurities. Natural hectorite is mainly composed of magnesium silicate. In hectorite, some of the exchangeable sodium ions have been replaced by lithium ions. In addition the structure contains some fluoride.

Bentonite has been used as a retention aid in paper production together with a cationic polymer in the patent U.S. Pat. No. 4,753,710 of Allied Colloids. In the process according to the patent, a cationic polymer, preferably polyethylene imine, a polyamine epichlorohydrin product, a polymer of diallyl dimethyl arrmonium chloride, or a polymer of acrylic monomers, was added to an aqueous cellulosic suspension before the last shearing stage, and bentonite was added after this shearing stage. Improved retention, dewatering, drying, and web forming properties were thereby achieved. In the microparticle system according to the method there is used bentonite, which is available under the trade name HYDROCOL.

Respectively, in the paper production method according to the patent U.S. Pat. No. 5,178,730 of Delta Chemicals, there is added to the pulp before the shearing stage a cationic polymer, which is preferably a tertiary or quaternary amine derivative of polyacrylamide, and after the shearing stage, before the headbox, there is added a natural hectorite at a weight ratio of 0.5:1–10:1. It has been observed that the combination of polymer and hectorite used in the method affects filler retention and dewatering more effectively than does, for example, bentonite used in a corresponding manner. The method according to the patent can be used in both alkaline and acid paper production recipes.

In the patent U.S. Pat. No. 5,876,563 of Allied Colloids, a cationic starch together with a cationic polymer and an anionic microparticulate material is used as the retention aid. The microparticulate material suggested for use in this connection is, for example, bentonite or colloidal silica or polysilicate microgels or polysilicic acid microgels together with aluminum-modified colloidal silica, or aluminum-modified polysilicate mnicrogel or aluminum-modified polysilicic acid microgel, of which a suspension is formed.

In the application WO 99/14432 of Allied Colloids, the microparticulate aid is preferably bentonite, colloidal silica, polysilicic acid, polysilicate microgel, or an aluminum-modified version thereof.

In Finnish patents 67735 and 67736, there is used, together with a hydrophobic size, a retention aid combination which contains, together with a polymer, preferably polyacrylamide, as an anionic component a colloidal silicic acid, bentonite, carboxymethyl cellulose or carboxylated polyacrylamide.

The use of silicate microparticles together with a cationic polymer in a retention system is described in the patent U.S. Pat. No. 5,194,120 of Delta Chemicals. The prevalent cation in the synthetic amorphous metal silicate was Mg, and the polymer was preferably a ternary or quaternary amine derivative of polyacrylamide, their weight ratio being between 0.03:1 and 30:1. By the method, retention, dewatering and formation were improved by using smaller amounts of retention aids than previously, and thus the costs were correspondingly lower.

According to our observations, when bentonite is used together with polyacrylamide, it serves as an effective microparticulate material in the retention system. Compared with this, a synthetic metal silicate in which the prevalent cation is Mg is, in a corresponding situation, not as effective as bentonite.

We have observed, surprisingly, that when there is used a microparticle mixture in which the major part consists of bentonite or hectorite and to which a small amount of a synthetic metal silicate having magnesium as the prevalent cation is added, the said mixture serves as a microparticulate material more effectively than does either component of the mixture, bentonite or hectorite or synthetic metal silicate, separately.

According to the invention there is thus provided a method for producing paper or board in such a manner that retention aids are added to the stock stream passing to the paper machine headbox, the stock stream is directed to the wire, the stock is dewatered in order to form a paper web, and the paper web is dried, the method being characterized in that the retention aids used are a solution of a water-soluble cationic polymer and a microparticle mixture which contains, in the form of a suspension, a swellable clay of the smectite group and a colloidal synthetic metal silicate, the prevalent cation in the synthetic metal silicate in the suspension being magnesium.

The said swellable clay of the smectite group, hereinafter in the specification referred to as clay material, is preferably bentonite or hectorite.

The microparticle mixture in the form of a suspension is preferably prepared by mixing the said clay material, preferably bentonite or hectorite, and the said metal silicate together while dry. A suspension is made from the dry mixture by slurrying the dry mixture in water, preferably to a concentration of 1–20%, and especially preferably to a concentration of approx. 5%.

The microparticle mixture can be transported and stored in the form of a suspension, but preferably the microparticle mixture is transported and stored in a dry form, and a suspension is prepared from it on site, immediately before use.

The proportion of the clay material in the microparticle mixture may be 85–99% by weight and that of the metal silicate 1–15% by weight. Preferably the mixing ratio of the synthetic metal silicate to the clay material is 0.03–0.1. The total amount of the microparticle mixture to be added to the stock is preferably at minimum 0.05%, especially preferably 0.1–0.25%, of the dry solids weight of the stock.

According to the invention, the retention aids are preferably added in steps so that first the solution of a cationic polymer is added, whereafter there follows a shearing process step for breaking up flocs, and thereafter the microparticle mixture in suspension form is added.

By the use of the microparticle mixture according to the invention, a surprisingly good retention is achieved, although when the clay material or the synthetic metal silicate is used alone as a retention aid, the retention result remains poorer. It can be assumed that the synergy advantage is based on the ability of the simultaneously added silicate to promote a more uniform distribution of the clay material particles into the aqueous phase, whereupon the surface area of the clay material particles can be exploited more effectively. When the microparticle mixture according to the invention is used as a retention aid, the filler retention may be up to 5 percentage points better than when the individual components of the mixture are used in the same amounts of dosage. A similar result is obtained for the total retention, even though the change is not as clearly observable as regarding the filler retention, since filler constitutes most of the stock fraction more difficult to retain on the wire.

The reproducibility of the measuring results is especially significant; without exception, a better retention result is always obtained with the mixture, regardless of the prodiiction conditions, than with the individual components of the mixture.

Furthermore, the color of the microparticle mixture is somewhat lighter than that of pure bentonite.

By the use of the microparticle mixture according to the invention a high retention is attained by using a smaller amount of retention aid as compared to the use of the individual components of the mixture. In this case, for example, dust problems and the consequent handling problems are smaller. The efficiency ratio of the use of microparticles is improved as the attained efficiency can be maintained constant and the amount of material to be added can be reduced.

The synthetic metal silicate according to the invention must have a sufficiently high and preferably controllable cation exchange capacity. Typically the exchangeable cation may be, for example, $Li^+$. The prevalent cation is magnesium, as in, for example, the product sold under the trade name of Laponite. The clay material may be any commercial bentonite or bentonite-type material, such as montmorillonite, beidellite, nontronite, saponite, sauconite, vermiculite or hectorite, or a chemically modified version of these. Advantageously bentonite can be used, for example, the Kemira Chemicals product sold under the trade name of Altonit SF or natural hectorite.

The cationic polymer used in the invention can be produced advantageously by copolymerizing acrylamide with a cationic monomer or methacrylamide with a cationic monomer. The molecular weight of the cationic polymer is preferably at least 500,000, and it is added to the stock preferably in an amount of at minimum 0.02%, especially preferably 0.03–0.05%, of the dry solids weight of the stock.

The cationic polymer used in the invention may be any copolymer of acrylamide and/or methacrylamide, prepared using at least as one of the comonomers a cationiccally charged or cationically chargeable monomer. Such monomers include methacryloyloxyethyltrimethyl ammonium chloride, acryloyloxyethyltrimethyl ammonium chloride, 3-(methacrylamido)propyltrimethyl ammonium chloride, 3-(acryloylamido)propyltrimethyl ammonium chloride, diallyldimethyl ammonium chloride, dimethylaminoethyl acrylate, dimethylaminoethyl methacrylate, dimethylaminopropylacrylamide, dimethylaminopropylmethacrylamide, or a similar monomer. The polymer may also contain monomers other than acrylamide, methacrylamide, or some cationic or cationizable monomer.

The cationic polymer may also be a polymer which has been treated afterwards to render it cationic, for example, a polymer prepared from polyacrylamide or polymethacrylamide by using Hofmann or Mannich reactions.

The cationic polymer may be prepared by conventional radical-initiation polymerization methods, and as a product it may be either dry powder or an emulsion of a polymer solution in an organic medium.

Before dosing, preferably an 0.05–0.5% solution, especially preferably an 0.1–0.3% solution, is prepared of the polymer, which solution may be further diluted before the feeding point in order to ensure good mixing.

The method according to the invention was observed to be robust with respect to various test arrangements, pulps, and fillers. The stock material and its initial pulp may, for example, be composed of a conventional chemical pulp or mechanical pulp or of other conventional raw materials used in paper making, such as recycled paper. The filler, which may be, for example, ground or precipitated calcium carbonate, kaolin, calcined kaolin, talc, titanium dioxide, gypsum, synthetic inorganic or organic filler, preferably, however, calcium carbonate, is incorporated into the pulp by a conventional method before the adding of the cationic polymer. The method according to the invention can be used in any conventional paper- or board-making apparatus. Furthermore, the method is not critical as regards the effect of the synthetic metal silicate type or of the mixing ratio of bentonite and metal silicate.

By the method according to the invention, retention can be improved further as compared with prior known methods and, at the same time, if so desired, the amount of the required retention aid can be reduced, whereupon any detrimental effects caused by its use are slighter.

The invention and its embodiments are described below with the help of various examples; the purpose of the examples is, however, not to restrict the scope of the invention.

EXAMPLE 1

Retention tests were carried out using a Dynamic Drainage Jar (DDJ) apparatus. The stock used was stock taken from a fine-paper machine, passing to the headbox. The stock sample had been taken just before retention aid additions. The filler content of the stock was 36% of the dry solids content of the stock. The filler was precipitated calcium carbonate. For the tests the stock was diluted with ion-exchanged water from the original consistency of 8.7 g/l to a consistency of 8.0 g/l. The pH of the stock was 8.1. The following, stepwise procedure was used in the tests:

1. At time 0 s, the mixing velocity being 1500 rpm, the stock sample was poured into a vessel.
2. At 10 s, the polymer was dosed into the stock.
3. At 30 s, the mixing velocity was lowered to 1000 rpm.
4. At 35 s, the microparticulate material or the microparticle mixture was dosed into the stock.
5. At 45 s, a filtrate sample was taken.

The wire used was a 200-mesh DDJ wire 125P. The polymer was a Kemira Chemicals cationic polyacrylamide (PAM1), which is a copolymer of acrylamide and acryloyloxyethyltrimethyl ammonium chloride and has a charge of approx. 1 meq/g and a molecular weight of approx. 7 Mg/mol. The bentonite used was Altonit SF of Kemira Chemicals. The synthetic metal silicate used, in which the prevalent cation was magnesium, was Laponite RD of Laporte. The dosages are indicated as the amount of the material dosed per dry solids weight of the stock, the unit being g/tonne. In the microparticle mixtures the mixing ratio is indicated in percentages by weight. The mixture contained bentonite 95% and synthetic metal silicate 5%. The retention results are shown in Table 1.

TABLE 1

Total retention and filler retention results both when bentonite and when a mixture of bentonite and a synthetic metal silicate (mixture) was used

| PAM1 | Microparticle | Filler retention, % | | Total retention, % | |
|---|---|---|---|---|---|
| g/tonne | g/tonne | Bentonite | Mixture | Bentonite | Mixture |
| 250 | 1000 | 16.4 | 18.9 | 64.8 | 67.6 |
| 250 | 2000 | 19.2 | 20.8 | 64.8 | 69.5 |
| 400 | 1000 | 31.0 | 31.5 | 71.2 | 71.6 |
| 400 | 2000 | 38.3 | 42.7 | 74.3 | 77.5 |
| 500 | 1000 | 38.9 | 47.7 | 75.1 | 79.4 |

With all PAM1 dosages it can be observed that the mixture of a synthetic microparticulate material and bentonite works with the same dosages better than does bentonite alone. At its most advantageous the mixture is, in the stock used here, at the highest PAM1 dosages (500 g/tonne), in which case a clear improvement is seen especially in the filler retention.

This example shows clearly that the retention results are always reproducibly better when a mixture of bentonite and a synthetic metal silicate is used than when bentonite alone is used.

EXAMPLE 2

Retention tests were performed mainly in the same manner as in Example 1, but the fine-paper machine used was not the same, and so the numerical values are not directly comparable with the values given in Example 1. The stock used was an artificial stock prepared in the laboratory, for which bleached chemical pine and birch pulps, used at a ratio of 1:1, were taken as a thick pulp from a fine-paper machine, The filler content in the stock was 40% of the dry solids content of the stock. The filler used was ground calcium carbonate. The pH of the stock was 7.5 and its consistency was 8.3 g/l. Tap water was used as the dilution water. The bentonite used was Hydrocol OA of Allied Colloids and Altonit SF of Kemira Chemicals. The synthetic metal silicate, in which the prevalent cation was magnesium, was Laponite RD (MSRD) of Laporte. The polymers were Hydrocol 847 of Allied Colloids and PAM1. The retention results are shown in Table 2. The results are the means of two parallel tests. The microparticle dosage was 2000 g/tonne.

TABLE 2

Total retention and filler retention results when bentonites of two different manufacturers were used, compared with a synthetic metal silicate

| Polymer | Polymer dosage, g/tonne | Microparticle | | Filler retention, % | Total retention, % |
|---|---|---|---|---|---|
| | | Bentonite | Silicate | | |
| Hydrocol 847 | 200 | Hydrocol OA | | 34.8 | 72.0 |
| Hydrocol 847 | 400 | Hydrocol OA | | 66.5 | 85.6 |
| PAM1 | 200 | Altonit SF | | 31.6 | 69.2 |
| PAM1 | 400 | Altonit SF | | 69.9 | 87.2 |
| PAM1 | 200 | | MSRD | 18.5 | 64.7 |
| PAM1 | 400 | | MSRD | 47.7 | 77.5 |

The results show that the synthetic metal silicate works clearly less effectively than either bentonite type.

From the combined results of this example and Example 1 it can be concluded that the rating order of the three microparticle compositions presented is synthetic silicate<bentonite<mixture of bentonite and synthetic metal silicate.

A mixture of a metal silicate and bentonite thus yields a better result than either pure component of the mixture separately.

EXAMPLE 3

Retention tests were performed mainly in the manner described in Example 1. The stock used was a stock taken from a fine-paper machine, passing to the headbox. The stock sample had been taken just before retention aid additions. The filler content in the stock was 38% of the dry solids content of the stock. The filler was precipitated calcium carbonate. The pH of the stock was 8.2 and its consistency was 7.8 g/l. The bentonite used was Altonit SF of Kemira Chemicals. The synthetic metal silicate was either Laponite RD (MSRD) of Laporte or its polyphosphate-modified version Laponite RDS (MSRDS). The polymer was PAM1, the dosage of which was 400 g/tonne. The proportion of the synthetic metal silicate in the mixture was 10% and that of bentonite was 90%. The retention results are shown in Table 3. The results are the means of two parallel test.

TABLE 3

Effect of the selection of the synthetic metal silicate on the retention improvement produced by the mixture

| Microparticle | Microparticle dosage, g/tonne | Filler retention, % | Total retention, % |
|---|---|---|---|
| Bentonite | 1000 | 65.4 | 83.0 |
| MSRD/bentonite | 1000 | 69.9 | 86.4 |
| MSDRS/bentonite | 1000 | 69.6 | 87.3 |
| Bentonite | 2000 | 68.9 | 85.5 |
| MSRD/bentonite | 2000 | 72.0 | 87.5 |
| MSRDS/bentonite | 2000 | 70.1 | 85.8 |

Regardless of the synthetic metal silicate used, filler retention is always better when a mixture is used than when bentonite alone is used as the microparticulate material. The difference caused in retention by different synthetic silicates is slight.

On the basis of the results shown in this example it was observed that the type of the synthetic metal silicate used in the mixture was hardly significant in terms of retention.

EXAMPLE 4

The test arrangements were as in Example 3. The proportion of synthetic metal silicate in the mixture was 5–10% and the proportion of bentonite was 90–95%. The results are shown in Table 4.

TABLE 4

Effect of the mixing ratio on retention when a mixture of bentonite and MSRD or of bentonite and MSRDS metal silicate is used.

| Microparticle | Microparticle dosage, g/tonne | Filler retention, % | Total retention, % |
|---|---|---|---|
| Bentonite | 2000 | 68.9 | 85.5 |
| MSRD/bentonite 5/95 | 2000 | 73.6 | 86.0 |
| MSRD/bentonite 10/90 | 2000 | 72.0 | 87.5 |
| MSRDS/bentonite 5/95 | 2000 | 71.6 | 87.3 |
| MSRDS/bentonite 10/90 | 2000 | 70.1 | 85.8 |

According to this example, the mixing ratio hardly affects retention, and the type of the synthetic metal silicate also does not have substantial significance.

EXAMPLE 5

Retention tests were performed using a Moving Belt Drainage Tester simulator. The simulator models the forming of a paper, web in conditions resembling web forming in a paper machine so that, during the forming of the web, pulsating scraping of the web and a very high vacuum level, typically in the order of −30 kPa, are used. The simulator is described in greater detail in Björn Krogerus's article "Laboratory testing of retention and drainage", p. 87 in Leo Neimo (ed.), Papermaking Science and Technology, Part 4, Paper Chemistry, Fapet Oy, Jyväskylä 1999.

The stock used was, in accordance with Example 1, stock taken from a fine-paper machine, passing to the headbox. The stock sample had been taken just before retention aid additions. The targeted vacuum level while air was being caused to flow through the sheet was −30 kPa. The effective suction time was 250 ms. The temperature of the stock during the tests was 45° C. The targeted gramrmage was 80 g/M$^2$. The mixing velocities were selected so as to be suitable for the simulator, according to the same principle as that shown in Table 1. The bentonite used was Altonit SF of Kemira Chemicals. The polymer was PAM1, with a dosage of 400 g/tonne. The retention results are shown in Table 5. The results are the means of 10 parallel tests.

TABLE 5

Retention results with different test arrangements when a microparticle mixture according to the invention was used

| Microparticle | Microparticle dosage, g/tonne | Total retention, % |
|---|---|---|
| Bentonite | 2000 | 90.4 |
| MSRDS/bentonite 5/95 | 1500 | 95.0 |
| MSRDS/bentonite 5/95 | 2000 | 98.5 |

The mixtures of a synthetic metal silicate and bentonite used yielded a clearly better retention result regardless of the dosage than did bentonite alone.

A comparison of the results obtained using a test arrangement according to Example 1 with the results obtained in the present example shows that mixtures of a synthetic metal silicate and bentonite improve retention results as compared with bentonite also when different test arrangements are used.

EXAMPLE 6

Retention tests were performed mainly in accordance with Example 1. The stock used was an artificial stock prepared in the laboratory, in which there was used a stock which had been taken from a fine-paper machine, passing to the headbox, and which contained precipitated calcium carbonate as a filler. Thick bleached chemical pine and birch pulps, taken from the same machine, and ground calcium carbonate were added to the stock. The sample of stock passing to the headbox had been taken just before retention aid additions. The filler content in the stock prepared for the test arrangements was 32% of the dry solids content of the stock. The filler was a mixture of precipitated and ground calcium carbonate. The pH of the stock was 8.1 and its consistency was 8.1 g/l. Ion-exchanged water was used as the dilution water. The bentonite used was Altonit SF of Kemira Chemicals. The retention results are shown in Table 6a.

TABLE 6a

Effect of the stock material on retention when artificial stock was used

| PAM1, g/tonne | Microparticle | Microparticle dosage, g/tonne | Filler retention, % | Total retention, % |
|---|---|---|---|---|
| 400 | Bentonite | 1000 | 60.4 | 84.4 |
| 400 | MSRD/bentonite 5/95 | 1000 | 63.0 | 86.8 |
| 500 | Bentonite | 2000 | 74.5 | 90.2 |
| 500 | MSRD/bentonite 5/95 | 2000 | 76.4 | 94.8 |

In addition, retention tests were performed using a laboratory-made artificial stock to which bleached chemical pine and birch pulps at a ratio of 1:2, taken as a thick pulp from the fine-paper machine, were added. The filler content in the stock was 36% of the dry solids content of the stock. The filler was ground calcium carbonate. The pH of the stock was 7.5 and its consistency was 7.7 g/l. Ion-exchanged water was used as the dilution water. The bentonite used was again Altonit SF of Kemira Chemicals and the synthetic metal silicate was either Laponite RD (MSRD) or RDS (MSRDS) of Laporte. The proportion of bentonite in the particle mixture was within the range of 90–99% and the proportion of metal silicates within the range of 1–10%. The polymer was PAM1, its dosage being 400 g/tonne. The obtained results are shown in Table 6b. The results are the means of two parallel tests.

TABLE 6b

Effect of stock material on retention when an artificial stock containing bleached chemical pulp is used

| Microparticle | Microparticle dosage, g/tonne | Filler retention, % | Total retention, % |
|---|---|---|---|
| Bentonite | 1000 | 69.3 | 89.9 |
| RD | 1000 | 67.5 | 87.9 |
| RDS | 1000 | 64.5 | 86.3 |
| MSRD/bentonite 2/98 | 1000 | 71.6 | 90.9 |
| MSRD/bentonite 5/95 | 1000 | 75.3 | 91.7 |
| MSRDS/bentonite 1/99 | 1000 | 72.8 | 90.5 |
| MSRDS/bentonite 5/95 | 1000 | 73.2 | 91.1 |
| MSRDS/bentonite 10/90 | 1000 | 74.8 | 91.6 |
| Bentonite | 2000 | 73.3 | 91.3 |
| MSRD/bentonite 2/98 | 2000 | 77.8 | 92.6 |
| MSRD/bentonite 5/95 | 2000 | 77.6 | 92.9 |
| MSRDS/bentonite 1/99 | 2000 | 77.0 | 91.7 |
| MSRDS/bentonite 5/95 | 2000 | 78.6 | 92.6 |
| MSRDS/bentonite 10/90 | 2000 | 78.3 | 92.4 |

The results clearly show the superiority of a mixture of bentonite and a synthetic metal silicate over pure bentonite or pure metal silicates, regardless of the stock material. In addition, the results show that the superiority of a mixture used according to Example 3 was independent of the synthetic metal silicate material in the case of the stock material concerned. The effect of a varied mixing ratio on the retention-improving property of the mixture used is slight, as can also be observed in Example 4, with a slightly different stock material.

EXAMPLE 7

Retention tests were performed using a Moving Belt Drainage Tester simulator, mainly as in Example 6. The stock used was stock taken from a machine producing LWC base paper, passing to the headbox. The stock sample had been taken just before retention aid additions. The pH of the stock was 7.6 and its consistency was 7.5 g/l. The targeted vacuum level while air was being caused to flow through the sheet was −30 kPa. The effective suction time was 250 ms. The temperature of the stock during the tests was 50° C. The targeted grammage was 50 g/m$^2$. The mixing velocities were selected so as to be suitable for the simulator, according to the same principle as shown in Table 1. The bentonite used was Altonit SF of Kemira Chemicals. The polymer was PAM1, as well as another cationic polyacrylamide, having a charge of approx. 2 meq/g and a molecular weight of approx. 5 Mg/mol (PAM2). The polymer dosage was 300 g/tonne. The filler content in the completed paper sheets was approx. 15%. The retention results are shown in Table 7. The results are the means of ten parallel tests.

TABLE 7

Effect of the pulp used on retention improved using a microparticle mixture according to the invention

| Polymer | Microparticle | Microparticle dosage, g/tonne | Total retention, % |
|---|---|---|---|
| PAM1 | Bentonite | 1000 | 66.1 |
| PAM1 | MSRD/bentonite 5/95 | 1000 | 71.6 |
| PAM1 | MSRD/bentonite 10/90 | 1000 | 70.7 |
| PAM2 | Bentonite | 1000 | 68.4 |
| PAM2 | MSRD/bentonite 5/95 | 1000 | 71.0 |
| PAM2 | MSRD/bentonite 10/90 | 1000 | 70.1 |

The obtained results indicate that mixtures of bentonite and a synthetic metal silicate work clearly better than does bentonite also with other than fine-paper pulps, in this case a stock containing coarse mechanical pulp.

EXAMPLE 8

Promoting Effect of MSRD on Action of Hectorite

A mixture of MSRD and hectorite has not been compared with hectorite alone within one and the same test series, but the action of each has been compared in different test series with the action of bentonite, and thus the promoting effect of MSRD on the action of hectorite can be concluded indirectly by comparing the action of each with the action of bentonite.

Retention tests were performed mainly in the manner described in Example 1. However, higher mixing velocities were used in the tests than in the test of Example 1, since it was desired to examine the action of microparticles at higher shear velocities in order to be closer to the retention values normally appearing in the paper machine. The dosage sequences used are described in Tables 8a and 8b.

TABLE 8a

Tests with hectorite as the microparticulate material. Stock consistency 8.1 g/l

| Point of time, s | Event |
|---|---|
| 0 | Mixing velocity 1500 rpm. Stock sample (500 ml) into vessel |
| 10 | Dosing of polymer |
| 30 | Mixing velocity 1980 rpm, |
| 35 | Dosing of microparticulate material |
| 45 | Collection of filtrate sample |

TABLE 8b

Tests using a mixture of MSRD and hectorite as the microparticulate material. Stock consistency 8.5 g/l

| Point of time, s | Event |
|---|---|
| 0 | Mixing velocity 1500 rpm. Stock sample (500 ml) into vessel |
| 10 | Dosing of polymer |
| 35 | Dosing of microparticulate material |
| 45 | Collection of filtrate sample |

The stock used was a laboratory-made artificial stock, for which bleached chemical pine and birch pulps (used at a ratio of 1:2) were taken as a high-consistency pulp from a fine-paper machine (a machine different from that in Example 1). The filler content in the stock was 40% of the dry solids content of the stock. The filler was ground calcuium carbonate. The pH of the stock was 7.5. The consistency in tests investigating the action of hectorite in comparison to bentonite was 8.1 g/l and in tests investigating the action of a mixture of MSRD and hectorite in comparison to bentonite was 8.5 g/l. The dilution water used was backwater taken from the paper machine and tap water together.

The hectorite used was Acti-Min 6000H, supplier ITC, Inc. The bentonite was Altonit SF and the polymer was PAM 1.

the retention results are shown in Tables 8c and 8d.

TABLE 8c

Action of hectorite compared with the action of bentonite. The results are the means of two parallel tests

| PAM1 dosage, g/tonne | Microparticle | Microparticle dosage, g/tonne | Filler retention, % |
|---|---|---|---|
| 400 | Hectorite | 1000 | 20.4 |
| 400 | Hectorite | 2000 | 26.5 |
| 400 | Bentonite | 1000 | 21.6 |
| 400 | Bentonite | 2000 | 24.7 |

TABLE 8d

Action of a mixture of MSRD and hectorite compared with the action of bentonite. The results are the means of two parellel tests

| PAM1 dosage, g/tonne | Microparticle | Microparticle dosage, g/tonne | Filler retention, % |
|---|---|---|---|
| 400 | MSRD/hectorite 5/95 | 1000 | 21.2 |
| 400 | MSRD/hectorite 5/95 | 2000 | 23.8 |
| 400 | MSRD/hectorite 10/90 | 1000 | 21.4 |
| 400 | Bentonite | 1000 | 18.9 |
| 400 | Bentonite | 2000 | 20.4 |

The filler retention attained with hectorite with a dosage of 1000 g/tonne is 94% of the filler retention attained with bentonite when bentonite is dosed in an equal amount.

The filler retention attained with hectorite with a dosage of 2000 g/tonne is respectively 107% of the filler retention attained with bentonite when bentonite is dosed in an equal amount.

The filler retention attained with a 5/95 mixture of MSRD and hectorite with a dosage of 1000 g/tonne is 112% of the filler retention attained with bentonite with the same dosage. The filler retention attained with a 10/90 mixture of MSRD and hectorite with-a dosage of 1000 g/tonne is 113% of the filler retention attained with bentonite when bentonite is dosed in an equal amount.

The filler retention attained with a 5/95 mixture of MSRD and hectorite with a dosage of 2000 g/tonne is 117% of the filler retention attained with bentonite when bentonite is dosed in an equal amount.

Thus, at a dosage of 1000 g/tonne the action of hectorite is weaker than that of bentonite, but the actions of mixtures of MSRD and hectorite are clearly better than that of bentonite. At a dosage of 2000 g/tonne the action of hectorite is better than that of bentonite, but that of a mixture of MSRD and hectorite is clearly even better. It can thus be concluded from the results that MSRD helps in improving the action of also hectorite in retention tests.

What is claimed is:

1. A method for the production of paper or board comprising:

(a) adding retention aids to a stream of stock entering a paper machine headbox, (b) directing the stream of stock to a wire, (c) dewatering the stock a paper web to form a paper web, and (d) drying the paper web, wherein the retention aids are (i) a solution of a water-soluble cationic polymer, and (ii) a suspension of a microparticle mixture containing a swellable smectite clay and a colloidal synthetic metal silicate, the prevailing cation of the colloidal synthetic metal silicate being magnesium, and wherein the microparticle mixture contains the swellable smectite clay in an amount of 85–99% by weight, and the colloidal synthetic metal silicate in an amount of 1–15% by weight.

2. The method according to claim 1, wherein said swellable smectite clay is bentonite.

3. The method according to claim 1, said swellable smectite clay is hectorite.

4. The method according to claims 1 to 3, wherein said retention aids are added in steps by (i) adding a solution of the cationic polymer, (ii) shearing the solution to break up flocs, and (iii) adding the suspension of microparticle mixture.

5. The method according to claim 1, wherein said cationic polymer is selected from the group consisting of a copolymer of aczylamide and a cationic monomer, and a copolymer of mechacrylamide and a cationic monomer.

6. The method according to claim 1, wherein the molecular weight of the cationic polymer is at minimum 500,000.

7. The method according to claim 1, said cationic polymer is used in an amount of at minimum 0.02% of the dry solids weight of the stock.

8. The method according to claim 1, wherein said microparticle mixture is used in an amount of at minimum 0.05% of the dry solids weight of the stock.

9. The method according to claim 1, the suspension of microparticle mixture is prepared from a swellable smectite clay and a solid colloidal synthetic magnesium silicate.

10. The method according to claim 1, wherein the stock contains cellulose, mechanical pulp, recycled fiber, or various combinations of these, as well as fillers and additives commonly used in the production of paper.

11. The method according to claim 10, wherein the filler is ground or precipitated calcium carbonate, kaolin, calcined kaolin, talc, titanium dioxide, gypsum, or a synthetic inorganic filler.

* * * * *